US009741551B2

(12) United States Patent
Makarov

(10) Patent No.: US 9,741,551 B2
(45) Date of Patent: Aug. 22, 2017

(54) ION DETECTION

(71) Applicant: Thermo Fisher Scientific (Bremen) GmbH, Bremen (DE)

(72) Inventor: Alexander Alekseevich Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/332,734

(22) Filed: Oct. 24, 2016

(65) Prior Publication Data

US 2017/0040152 A1 Feb. 9, 2017

Related U.S. Application Data

(62) Division of application No. 13/993,316, filed as application No. PCT/EP2011/072790 on Dec. 14, 2011.

(30) Foreign Application Priority Data

Dec. 14, 2010 (GB) ..... 1021232.2

(51) Int. Cl.

| | |
|---|---|
| ***H01J 49/00*** | (2006.01) |
| ***H01J 49/28*** | (2006.01) |
| ***H01J 49/02*** | (2006.01) |
| ***H01J 49/38*** | (2006.01) |
| ***H01J 49/42*** | (2006.01) |
| ***H01J 49/08*** | (2006.01) |

(52) U.S. Cl.
CPC ..... *H01J 49/282* (2013.01); *H01J 49/027* (2013.01); *H01J 49/08* (2013.01); *H01J 49/38* (2013.01); *H01J 49/4245* (2013.01)

(58) Field of Classification Search
None
See application file for complete search history.

(56) References Cited

U.S. PATENT DOCUMENTS

| | | | | |
|---|---|---|---|---|
| 4,686,365 A * | 8/1987 | Meek | H01J 49/38 | 250/281 |
| 5,436,447 A | 7/1995 | Shew | | |
| 5,481,107 A * | 1/1996 | Takada | G01N 30/728 | 250/281 |
| 5,528,034 A * | 6/1996 | Yamazaki | G01N 23/2258 | 250/288 |

(Continued)

FOREIGN PATENT DOCUMENTS

| | | |
|---|---|---|
| GB | 2434484 A | 7/2007 |
| GB | 2470600 A | 12/2010 |
| WO | 2007/000587 A2 | 1/2007 |

*Primary Examiner* — Andrew Smyth
(74) *Attorney, Agent, or Firm* — David A. Schell

(57) ABSTRACT

Mass analyzers and methods of ion detection for a mass analyzer are provided. An electrostatic field generator provides an electrostatic field causing ion packets to oscillate along a direction. A pulse transient signal is detected over a time duration that is significantly shorter than a period of the ion oscillation or using pulse detection electrodes having a width that is significantly smaller than a span of ion harmonic motion. A harmonic transient signal is also detected. Ion intensity with respect to mass-to-charge ratio is then identified based on the pulse transient signal and the harmonic transient signal.

11 Claims, 7 Drawing Sheets

(56) References Cited

U.S. PATENT DOCUMENTS

| | | | | | |
|---|---|---|---|---|---|
| 5,572,022 | A * | 11/1996 | Schwartz | H01J 49/4265 | 250/282 |
| 7,968,082 | B1 * | 6/2011 | Shriver | A61K 31/727 | 424/9.3 |
| 8,825,413 | B2 * | 9/2014 | Misharin | H01J 49/0036 | 702/189 |
| 2008/0203293 | A1 * | 8/2008 | Makarov | H01J 49/0009 | 250/283 |
| 2008/0315080 | A1 * | 12/2008 | Makarov | H01J 49/425 | 250/281 |
| 2009/0078866 | A1 * | 3/2009 | Li | H01J 49/425 | 250/297 |
| 2010/0116982 | A1 * | 5/2010 | Iwamoto | H01J 49/164 | 250/292 |
| 2011/0251801 | A1 * | 10/2011 | Misharin | H01J 49/0036 | 702/32 |
| 2012/0091332 | A1 * | 4/2012 | Makarov | H01J 49/40 | 250/282 |
| 2012/0119078 | A1 * | 5/2012 | Green | H01J 49/4265 | 250/282 |
| 2012/0138785 | A1 * | 6/2012 | Makarov | H01J 49/406 | 250/282 |
| 2013/0068942 | A1 * | 3/2013 | Verenchikov | H01J 49/4245 | 250/282 |

* cited by examiner

ION DETECTION

TECHNICAL FIELD OF THE INVENTION

The present invention relates to a mass analyzer or a method of ion detection for a mass analyzer.

BACKGROUND TO THE INVENTION

Fourier Transform Mass Spectrometry (FTMS) uses an electromagnetic field in which coherent packets of ions undergo free harmonic oscillations within the analyzer with a period that is a function of their mass to charge (m/z) ratio. The electromagnetic field can be provided by the combination of an electrostatic field and a magnetostatic field, for example in a Fourier Transform Ion Cyclotron Resonance (FTICR) mass analyzer, or by an electrostatic field only, for example in an orbital trapping mass analyzer (marketed under the name Orbitrap™). FTMS using RF fields are also known, but did not become widespread due to limited analytical performance.

Typically, ions are detected by an image current generated in detection electrodes as the ions pass nearby. It is known that the resolving power of m/z analysis in FTMS is limited by the Fourier Transform uncertainty principle. This rigidly links the resolving power to the number of detected coherent oscillations of ion packets. As a result, increasing the detection time in an FTMS mass analyzer results in a proportional improvement of resolving power of m/z analysis.

Frequently, liquid separation is performed before mass analysis and the increasing speed of such separation is putting pressure on the detection time in mass spectrometry and tandem mass spectrometry analysis. Reducing detection time without significantly affecting resolving power is a major challenge in FTMS.

Existing approaches deal with data processing of the harmonic transient image current, also termed a continuous transient image current, that is generated when the detection time is at least the length of the ion packet oscillation period. For example, the following approaches have been considered: auto-correlation (see Marshall A. G.; Verdun, F. R., "Fourier Transforms in NMR, optical and mass spectrometry", Elsevier, 1990, p. 150-155); Linear Prediction (see Guan S., Marshall A. G., "Linear Prediction Cholesky Decomposition vs Fourier Transform Spectral Analysis for Ion Cyclotron Resonance Mass Spectrometry", Anal. Chem., 1997, 69 (6), pp 1156-1162 and U.S. Pat. No. 5,047,636); and Filter Diagonalization Method (FDM) (see Mandelshtam, V. A., "FDM: The filter diagonalization method for data processing in NMR experiments", Prog. Nucl. Magn. Res. Spectrosc., 2001, 38, p. 159-196).

These existing approaches attempt to fit the harmonic transient, which is a time-domain signal, to a sum of sinusoids or cosinusoids. This is known as the harmonic inversion problem and is a difficult non-linear fitting problem, especially for a large number of noisy peaks typical for mass spectrometry. Noisy data impedes the construction of a list of peaks or spectral lines from the harmonic transient using these alternatives to Fourier Transforms. Alternative methods to obtain data, to analyze data or both using FTMS are desirable to reduce detection time without degradation in resolving power.

SUMMARY OF THE INVENTION

Against this background, the present invention provides a mass analyzer, comprising: an electrostatic field generator, arranged to provide an electrostatic field causing ion packets to oscillate along a longitudinal direction with a period; a pulse detection electrode arrangement, configured to detect a pulse transient signal; a harmonic detection electrode arrangement, configured to detect a harmonic transient signal; and a processor, configured to identify ion intensity with respect to mass-to-charge ratio, based on the harmonic transient signal and the pulse transient signal. Preferably, the pulse detection electrode arrangement is configured to detect the pulse transient signal over a time duration that is significantly shorter than the period of the ion packet oscillation. The time duration for detection of the pulse transient signal may be no more than 75%, 50%, 25%, 10%, 5%, 1% or 0.5% of the period of the ion packet oscillation. Optionally, the harmonic detection electrode arrangement is configured to detect the harmonic transient signal continuously over at least the period of the ion packet oscillation.

In a second aspect, the present invention provides a mass analyzer, comprising: an electrostatic field generator, arranged to provide an electrostatic field causing ion packets to form that oscillate along a longitudinal direction with a period; a pulse detection electrode arrangement, configured to detect a pulse transient signal over a time duration that is significantly shorter than the period of the ion packet oscillation; a harmonic detection electrode arrangement located at least at the turning points of ion packets in the longitudinal direction, configured to detect a harmonic transient signal comprising an image current; and a processor, configured to identify ion intensity with respect to mass-to-charge ratio, based on the pulse transient signal and the harmonic transient signal. Optionally, the harmonic detection electrode arrangement comprises a plurality of electrodes, each of the plurality of electrodes being maintained at different potentials.

In a third aspect, there is provided a mass analyzer, comprising: an electrostatic field generator, arranged to provide an electrostatic field causing coherent ion packets to perform harmonic motion along at least one direction with a period; a pulse detection electrode arrangement, configured to detect a pulse transient signal over a time duration that is significantly shorter than the period of the ion packet harmonic motion; a harmonic detection electrode arrangement, configured to detect a harmonic transient signal continuously over a time duration which is at least: 80%; 50%; or 30% relative to the total time of ion packet harmonic motion; and a processor, configured to identify ion intensity with respect to mass-to-charge ratio, based on the pulse transient signal and the harmonic transient signal.

In a fourth aspect, there may be found a mass analyzer, comprising: an electrostatic field generator, arranged to provide an electrostatic field causing coherent ion packets to perform harmonic motion along a span in a longitudinal direction; a pulse detection electrode arrangement, configured to detect a pulse transient signal, the pulse detection electrode arrangement comprising at least one pulse detection electrode, each of the at least one pulse detection electrodes having a width in the longitudinal direction that is significantly smaller than the span of harmonic motion; a harmonic detection electrode arrangement, configured to detect a harmonic transient signal; and a processor, configured to identify ion intensity with respect to mass-to-charge ratio, based on the pulse transient signal and the harmonic transient signal. The span of harmonic motion may be the peak-to-peak distance travelled by the ions. Optionally, each of the at least one pulse detection electrodes has a width in the longitudinal direction that is no greater than 50%, 25%, 10%, 5%, 2% or 1% of the span of harmonic motion.

The use of a pulse detection electrode arrangement together with a harmonic detection electrode allows additional data to be obtained from the mass analyzer. Advantageously, the harmonic transient signal and the pulse transient signal are obtained at substantially the same time. The combination of these two signals, which in the preferred embodiment are both image current signals, allows a range of different data processing techniques to be used. In fact, the pulse transient signal can beneficially be used to improve a spectral line list obtained using the harmonic transient signal.

A harmonic transient signal is usually understood as a signal that contains, for each ion, sinusoidal, cosinusoidal or both signals of a limited frequency range. More specifically, this limited frequency range is typically narrow and around the frequency of ion axial oscillations in the device. In some cases, the limited frequency range may only comprise the frequency of ion axial oscillations, although in other cases it may include the third, possibly fifth and optionally higher harmonics of this frequency. Where the third or fifth or higher harmonics are present, their total contribution to the overall power in the signal is usually no more than 5%, 3% or 1%. In contrast, a pulse transient signal will typically comprise, for each ion, a series sinusoidal, cosinusoidal or both signals of the frequency of ion axial oscillations and a significant number of harmonics of this frequency. Moreover, the harmonics contribute a significant percentage to the overall power in the signal, for example at least 5%, 10%, 25% or 50% of the total signal power.

Further features of the invention are now described, which are applicable to each of the different aspects of the present invention. It will be recognised that many these features can be combined together and not all of such combinations are explicitly identified below.

Optionally, the processor is further configured to identify ion intensity with respect to mass-to-charge ratio by processing of the harmonic transient signal using at least one of: Fourier transformation; linear prediction method; filter diagonalization method; and any other harmonic inversion method. The filter diagonalization method can be employed, optionally together with the analysis method applied to the pulse transient signal, to provide a list of mass-to-charge ratios and associated ion intensities, which is iteratively improved using both signals.

The processor may optionally be configured to identify ion intensity with respect to mass-to-charge ratio by processing of the pulse transient signal using at least one of: auto-correlation; linear prediction; filter diagonalization method; any other harmonic inversion method; and wavelet transformation. These techniques, in particular, wavelet transformation, may be well suited to analysis of pulse transient signals. The use of Wavelet transformation is preferred over Fourier transformations, since Fourier transformations would give harmonics from thin strip detector electrodes, with the signal spread amongst the harmonics.

Beneficially, the pulse detection electrode arrangement comprises at least one detection electrode having a width in the longitudinal direction such that ion packets transit near the at least one detection electrode for a duration that is substantially shorter than the half-period of the ion packet oscillation. Preferably, the width is such that the duration of transit for the ion packets is no more than one of: 50%; 25; 12.5%; or 6.25% than the half-period of the ion packet oscillation. Adjusting the width of the electrode may allow a pulse transient signal to be detected, preferably an image current signal.

In the preferred embodiment, the mass analyzer further comprises: an outer electrode coaxial with at least an inner electrode, the electrostatic field generator arranged to provide the electrostatic field between the outer electrode and the inner electrode. The mass analyzer is an electrostatic trap and the electrostatic field is formed using an electric field, for example as in an orbital trapping mass analyzer. The inner and outer electrodes are advantageously arranged such that a hyper-logarithmic electrostatic field is generated. Alternatively, other types of electrostatic trap arrangements can be used, such as those described in DE-04408489, U.S. Pat. No. 3,226,543, U.S. Pat. No. 3,621,242, U.S. Pat. No. 5,880,466, U.S. Pat. No. 6,888,130, U.S. Pat. No. 6,903,333, U.S. Pat. No. 7,755,040, WO-2007/109672, WO-2010/072137. Also, any Fourier Transform Ion Cyclotron Resonance mass analyzer can be used as a further alternative.

When an orbital trapping mass analyzer is used, a number of optional implementation features can be considered. In some embodiments, the pulse detection electrode arrangement is formed using at least a part of at least one of: the inner electrode; and the outer electrode. The pulse transient signal comprises an image current detected at the pulse detection electrode arrangement. Then, at least one of: the inner electrode; and the outer electrode may optionally comprise a first side electrode portion, a second side electrode portion and a central electrode portion located between the first and second side electrode portions and separated therefrom by electrically insulating portions, the pulse detection electrode arrangement being formed from the central electrode portion. The pulse transient signal is beneficially an image current in such embodiments.

In these embodiments, the at least one of: the inner electrode; and the outer electrode may be advantageously formed from an insulator, the first and second side electrode portions and the central electrode portion being formed from metallisation on the surface of the insulator. Beneficially, the inner electrode is configured such that the resistance between each of the first and second side electrode portions and the central electrode portion is at least 100 MΩ. More preferably, the at least one of: the inner electrode; and the outer electrode is configured such that the resistance between each of the first and second side electrode portions and the central electrode portion is no greater than $10^{12}$ to $10^{14}\Omega$. In one embodiment, the insulator is made from glass.

Optionally, the mass analyzer further comprises a conductor, arranged to provide the pulse transient signal to the edge of the at least one of the: inner electrode; and the outer electrode, the conductor being formed by metallisation on the surface of the insulator. Alternatively, the mass analyzer further comprises a conductor, arranged to provide the pulse transient signal to the edge of the at least one of: the inner electrode; and the outer electrode, the conductor being formed outside the volume in which ions are trapped.

In embodiments, the central electrode portion may comprise a first central electrode part and a second central electrode part, the pulse transient signal comprising a combination of an image current generated in the first central electrode part and an image current generated in the second central electrode part. Beneficially, this allows common mode noise to be rejected, by combining two pulse transient image currents.

In an alternative embodiment, the pulse detection electrode arrangement may comprise: a conversion electrode mounted interior to the mass analyzer, the electrostatic field being configured such that ion packets hit the conversion electrode, causing secondary electrons to be emitted; a grid electrode mounted exterior to the mass analyzer and located to receive the secondary electrons from the conversion electrode; a dynode, arranged to receive secondary electrons from the grid electrode; and microchannel plates or a secondary electron multiplier, arranged to detect secondary electrons received from the dynode. The pulse transient signal thereby beneficially comprises the signal generated at the microchannel plates or the secondary electron multiplier. Such an embodiment can result in an improved Signal-to-Noise ratio in comparison with other detection schemes. Preferably, the conversion electrode is spatially separated from the inner electrode and the outer electrode.

Advantageously, the pulse detection electrode arrangement comprises a first pulse detection electrode and a second pulse detection electrode, the mass analyzer further comprising a pulse differential amplifier, arranged to provide the pulse transient signal based on the difference between a signal generated in the first pulse detection electrode and a signal generated in the second pulse detection electrode.

In many embodiments, the harmonic detection electrode arrangement may comprise a first harmonic detection electrode and a second harmonic detection electrode, the mass analyzer further comprising a harmonic differential amplifier, arranged to provide the harmonic transient signal based on the difference between an image current generated in the first harmonic detection electrode and an image current generated in the second harmonic detection electrode. Optionally, the first harmonic detection electrode comprises a first portion of an inner electrode of the mass analyzer and the second harmonic detection electrode comprises a second portion of an inner electrode of the mass analyzer. Alternatively, an outer electrode of the mass analyzer may comprise a first outer electrode part and second outer electrode part and the first harmonic detection electrode comprises the first outer electrode part and the second harmonic detection electrode comprises the second outer electrode part.

In a further aspect, there is provided a method of ion detection for a mass analyzer in which ions are caused to form ion packets that oscillate along a longitudinal direction with a period. The method comprises: detecting a pulse transient signal; detecting a harmonic transient signal; and identifying ion intensity with respect to mass-to-charge ratio, based on the harmonic transient signal and the pulse transient signal. The mass analyzer beneficially causes ions to form ion packets that oscillate along a longitudinal direction with a period by generating an electrostatic field. Preferably, detection of the pulse transient signal occurs over a time duration that is shorter than the period of the ion packet oscillation. Optionally, detection of the harmonic transient signal occurs continuously over at least a significant part of each period of the ion packet oscillation.

In another aspect, there is provided a method of ion detection for a mass analyzer in which ions are caused to form ion packets that oscillate along a longitudinal direction with a period. The method comprises: detecting a pulse transient signal over a time duration that is significantly shorter than the period of the ion packet oscillation; detecting an harmonic transient signal comprising an image current signal detected at least at the turning points of ion packets in the longitudinal direction; and identifying ion intensity with respect to mass-to-charge ratio, based on the harmonic transient signal and the pulse transient signal. Optionally, the harmonic transient signal comprising an image current is detected using a plurality of electrodes, each of the plurality of electrodes being maintained at different potentials.

In a yet further aspect of the present invention, there may be found a method of ion detection for a mass analyzer in which ions are caused to form coherent ion packets that perform harmonic motion along at least one direction with a period. The method comprises: detecting a pulse transient signal over a time duration that is significantly shorter than the period of the ion packet harmonic motion; detecting a harmonic transient signal continuously over a time duration which is at least: 80%; 50%; or 30% relative to the total time of ion packet harmonic motion; and identifying ion intensity with respect to mass-to-charge ratio, based on the harmonic transient signal and the pulse transient signal.

There is provided in yet another aspect of the present invention, a method of ion detection for a mass analyzer in which ions are caused to form coherent ion packets that perform harmonic motion along a span in a longitudinal direction. The method comprises: detecting a pulse transient signal using at least one pulse detection electrode, each of the at least one pulse detection electrodes having a width in the longitudinal direction that is significantly smaller than the span of harmonic motion; detecting a harmonic transient signal; and identifying ion intensity with respect to mass-to-charge ratio, based on the harmonic transient signal and the pulse transient signal.

Preferably, the step of identifying ion intensity with respect to mass-to-charge ratio comprises processing the pulse transient signal using at least one of: auto-correlation; linear prediction; filter diagonalization method; and wavelet transformation.

Optionally, the step of identifying ion intensity with respect to mass-to-charge ratio further comprises processing of the harmonic transient signal using at least one of: Fourier transformation filter diagonalization method; and any other harmonic inversion method.

In some embodiments, the step of identifying ion intensity with respect to mass-to-charge ratio further comprises: processing the pulse transient signal to identify a preliminary set of frequencies and associated intensities; and processing the harmonic transient signal together with the preliminary set of frequencies and associated intensities to determine ion intensity with respect to mass-to-charge ratio. This allows improved identification of mass spectra peaks at higher speeds than existing systems, due to the processing of the pulse transient signal in parallel with the harmonic transient signal and using the two signals in combination to provide an improved mass spectrum.

Optionally, the step of processing the harmonic transient signal together with the preliminary set of frequencies and associated intensities uses a filter diagonalization method.

Preferably, the step of detecting a pulse transient signal uses a pulse detection electrode arrangement comprising at least one detection electrode having a width in the longitudinal direction such that ion packets transit near the at least one detection electrode for a duration that is shorter than the period of the ion packet oscillation.

In some embodiments, the mass analyzer further comprises: an outer electrode coaxial with an inner electrode, the ion packets being caused to oscillate by an electrostatic field between the outer electrode and the inner electrode. Then, the step of detecting the pulse transient signal optionally uses at least a part of at least one of: the inner electrode; and the outer electrode.

Optionally, the inner electrode comprises a first side electrode portion, a second side electrode portion and a central electrode portion located between the first and second side electrode portions and separated therefrom by electrically insulating portions, the step of detecting the pulse transient signal using the central electrode portion. Alternatively, the step of detecting the pulse transient signal may comprise: causing ion packets to hit a conversion electrode mounted interior to the mass analyzer, so that secondary electrons are emitted; and detecting the secondary electrons exterior to the mass analyzer.

Beneficially, the step of detecting the pulse transient signal comprises: detecting a first pulse signal using a first pulse detection electrode; detecting a second pulse signal using a second pulse detection electrode; and determining the pulse transient signal based on the difference between the first pulse signal and the second pulse signal.

It will also be understood that additional process steps for each of the method aspects corresponding with the apparatus features discussed herein are optionally included.

In a further aspect, there is provided a computer program, configured to carry out the method disclosed herein when operated on a processor. The present invention may also comprise a computer readable medium, arranged to carry this computer program and a processor programmed to operate according to this computer program.

BRIEF DESCRIPTION OF THE DRAWINGS

The present invention may be put into practice in various ways, a number of which will now be described by way of example only and with reference to the accompanying drawings in which.

DETAILED DESCRIPTION OF PREFERRED EMBODIMENTS

Figure 1:
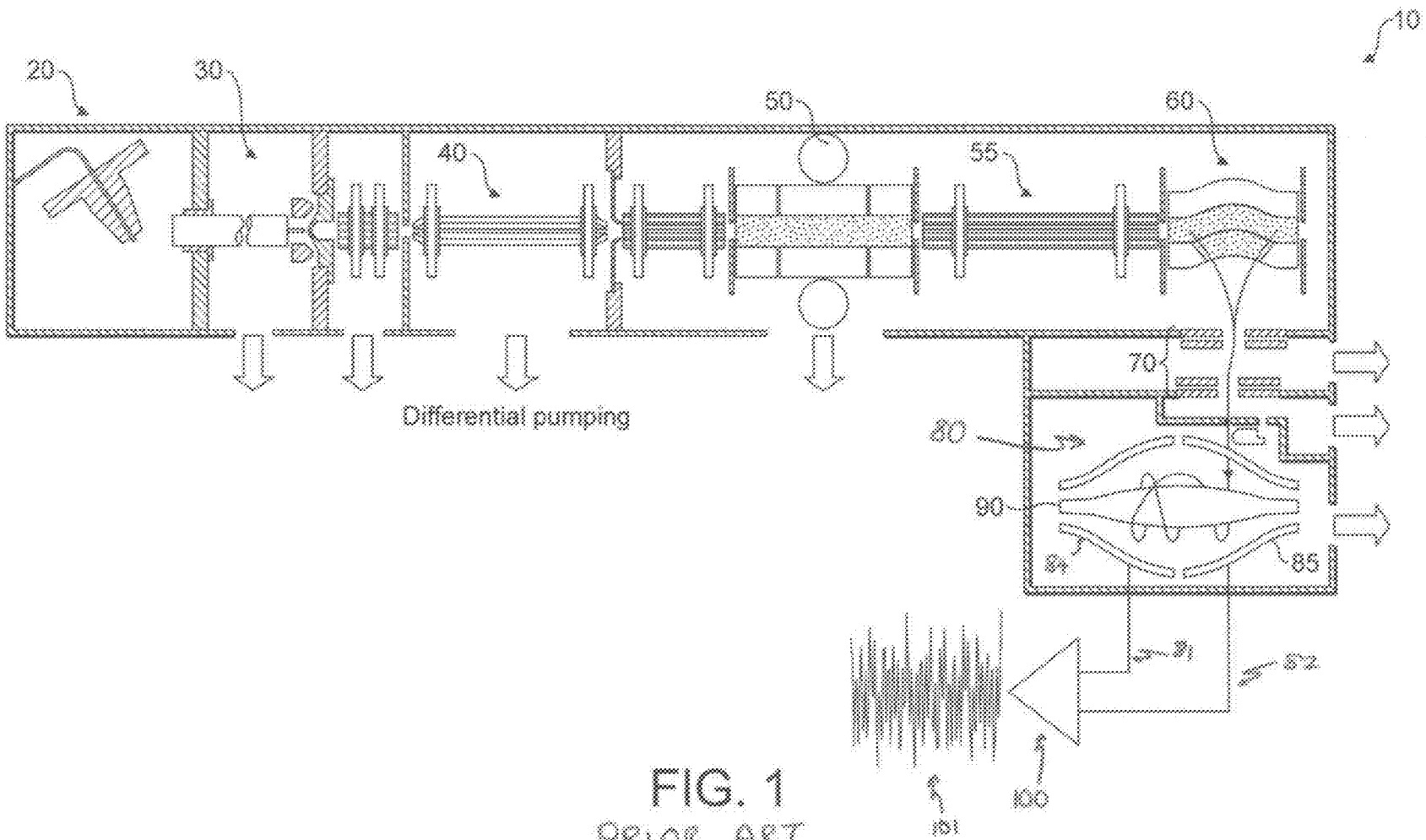
FIG. 1 PRIOR ART
FIG. 1 shows a schematic arrangement of a mass spectrometer according to the prior art and including an electrostatic trap.

Referring first to FIG. 1, there is shown a schematic arrangement of a mass spectrometer in accordance with the prior art, including an electrostatic trap. The arrangement of FIG. 1 is described in detailed in commonly assigned WO-A-02/078046 and will not be described in detail here. A brief description of FIG. 1 is, however, included in order to understand the use and purpose of the electrostatic trap better. One embodiment of the present invention uses this electrostatic trap.

As seen in FIG. 1, the mass spectrometer 10 includes a continuous or pulsed ion source 20 which generates gas-phase ions. These pass through an ion source block 30 into an RF transmission device 40, which cools ions by collisions with gas. The cooled ions then enter a mass filter 50, which extracts only those ions within a window of m/z ratios of interest. Ions within the mass range of interest then proceed into a linear trap 60 (typically, a C-trap), which stores ions in a trapping volume through application of an RF potential to a set of rods (typically quadrupole, hexapole or octapole).

As explained in more detail in WO-A-02/078046, ions are held in the linear trap 60 in a potential well, the bottom of which may be located adjacent to an exit electrode thereof. Ions are ejected out of the linear trap 60 into a lens arrangement 70 by applying a DC pulse to the exit electrode of the linear trap 60. Ions pass through the lens arrangement 70 along a line that is curved to avoid gas carry-over, and into an electrostatic trap 80. In FIG. 1, the electrostatic trap 80 is the so-called orbital trapping type (commercially known as "Orbitrap"™), which contains a split outer electrode 84, 85 and an inner electrode 90.

In operation, a voltage pulse is applied to the exit electrode of the linear trap 60 so as to release trapped ions. The ions arrive at the entrance to the electrostatic trap 80 as a sequence of short, energetic packets of similar m/z ratio. Such packets are ideally suited to an electrostatic trap, which requires coherency of ion packets for detection to take place.

The ions entering the electrostatic trap 80 as coherent bunches are squeezed towards the central electrode 90. The ions are then trapped in an electrostatic field such that they move in three dimensions within the trap and are captured therein. Initial bunches spread into thin rings that oscillate along the central electrode. Image currents are detected by the first outer electrode 84 and the second outer electrode 85, providing first harmonic transient signal 81 and second harmonic transient signal 82 respectively. These two signals are then processed by a differential amplifier 100 and provide a harmonic transient image current signal 101.

Figure 2:
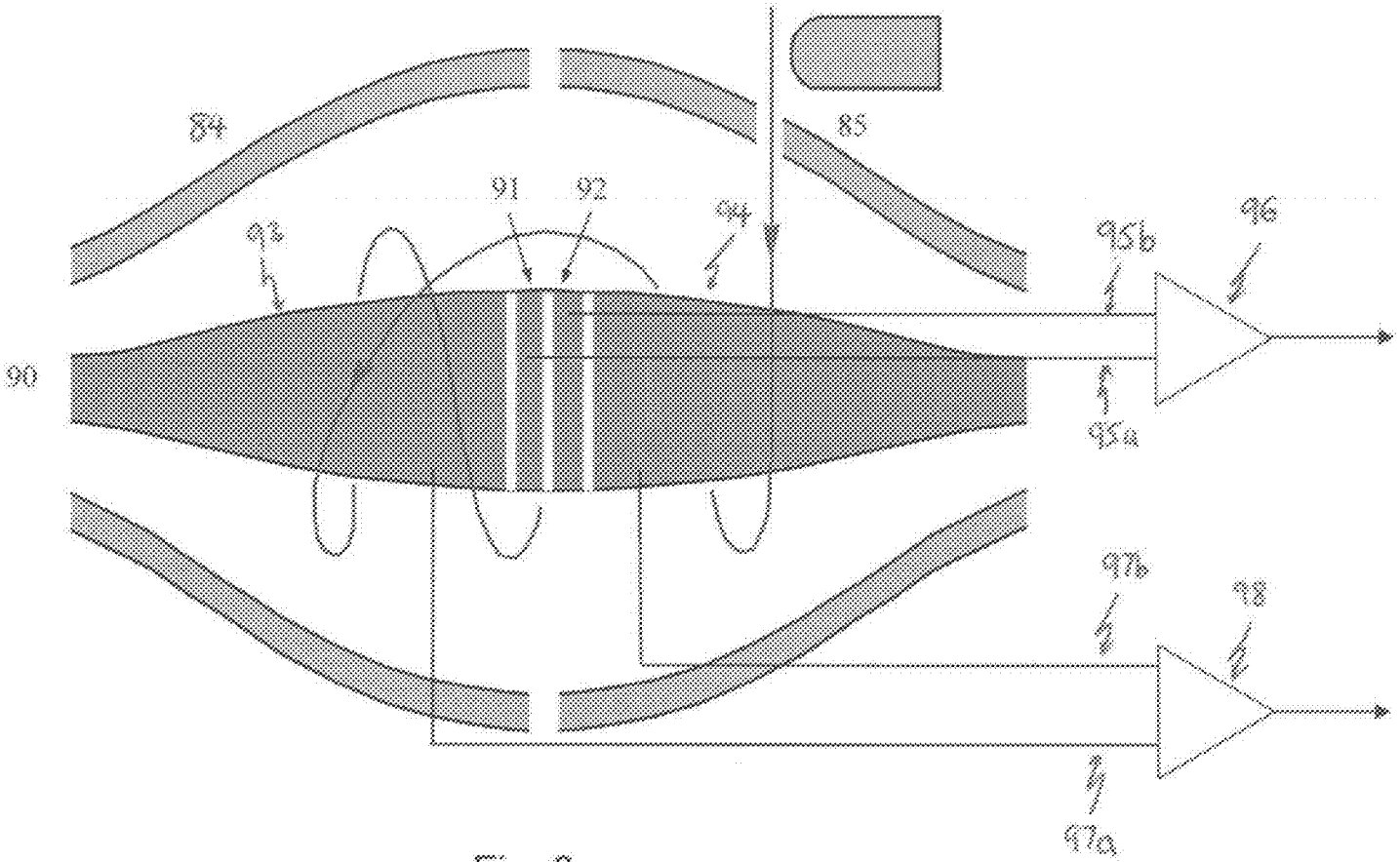
FIG. 2 shows a schematic arrangement of an electrostatic trap according to a first embodiment of the present invention.

Referring next to FIG. 2, a first embodiment of an electrostatic trap according to the present invention is shown. Where the same components to those identified in FIG. 1 are shown, identical reference numerals are used.

Central electrode 90 is formed in such a way that a first detection strip electrode 91 and a second detection strip electrode 92 are near the centre of the electrode. A first side electrode 93 and a second side electrode 94 are also formed in this way. The first strip electrode 91 and the second strip electrode 92 are near the centre of the central electrode 90 (z=0), such that they are closest to the beam. The beam has a cylindrical envelope as in existing instruments.

After ions are injected through the injection slot of the electrostatic trap analyzer and brought closer to the central electrode 90 by ramping the voltage between centre electrode 90 and outer electrodes 84 and 85, the ions move on a stable circular spiral trajectories at a desired radius. If the central electrode 90 is machined with adequately high accuracy, ions could be brought closer to it during the detection process and fly at a distance dR from the central electrode, dR being smaller than each of the width of the first detection strip electrode 91 and second detection strip electrode 92. Due to the curvature of equipotentials, dR could be made significantly smaller for strips on the central electrode 90 rather than on the outer electrodes 84 and 85.

While flying near strip electrode 91 and strip electrode 92, ions of each m/z ratio induce a periodic pulse image current. A first periodic pulse image current is then provided by conductor 95*a* and a second pulse image current is then provided by conductor 95*b*. These two pulse image currents are provided to first differential amplifier 96, which provides an output that excludes common-mode noise and amplifies it for further processing.

In parallel, first side electrode 93 and second side electrode 94 also provide first transient image current 97*a* and second transient image current 97*b* to a second differential amplifier 98. As a consequence, two transients are obtained for the same ion injection: one pulse transient from strip electrodes 91 and 92; and one harmonic transient from the wider electrodes. Preferably, two-channel ADC of appropriate acquisition rate is used to digitise both signals.

The use of strip electrodes 91 and 92 generally only affects differential output for the harmonic transient image current by increasing the 3rd harmonic from 2-3% to 4-5%. This typically causes a small kink in the sine wave as it goes through zero.

Figure 3:
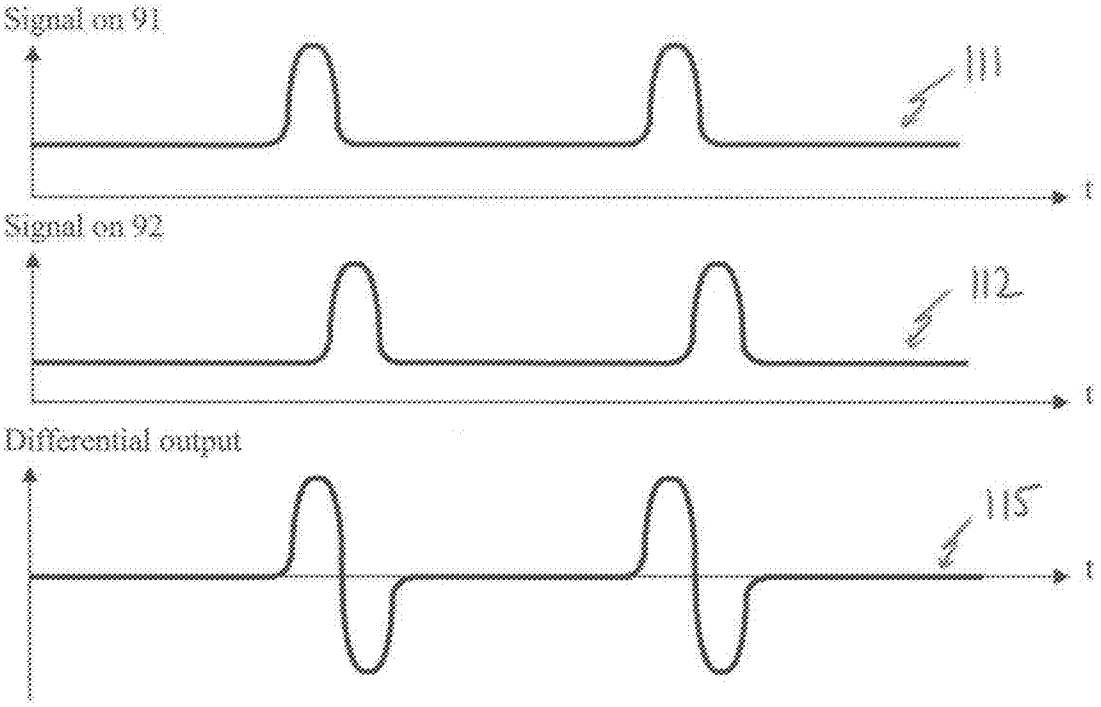
FIG. 3 illustrates exemplarily signals generated by the embodiment shown in FIG. 2.

Referring to FIG. 3, there is shown exemplary pulse transient signals obtained through the electrostatic trap of FIG. 2. A first pulse transient signal 111 is the signal generated from strip electrode 91. A second pulse transient signal 112 is the signal generated by strip electrode 92. Then, differential output signal 115 is the output from the differential amplifier 96.

The period of the detected pulse signal equals the duration of half-oscillation of ions in the analyzer:

$$\Gamma = \frac{\pi}{\omega} = \pi\sqrt{\frac{m}{z \cdot e \cdot k}}$$

and temporal width dT of the peak detected by the strip of width d at the centre of the trap could be estimated as:

$$dT \approx \frac{d}{\omega \cdot L} = T \cdot \frac{d}{n \cdot L}$$

where L is the amplitude of stable axial oscillations in the electrostatic trap analyzer 80 and d is assumed to exceed the maximum size of the ion packet in the axial direction. If this condition is not satisfied, then the root-mean-square of d and maximum axial size of the ion packet could be used. Similar formulae could be deduced for other types of FTMS.

Such pulse periodic signals are well-suited to analysis by wavelet transformation. This is described in U.S. Pat. No. 5,436,447, for example. There, this transformation is used for purposes of isotope intensity recovery. The so-called "mother wavelet" could be chosen as a best approximation for the function shown in FIG. 3 and is then dilated and translated along a temporal access as a smooth function of m/z.

The advantage of using wavelet transformation is potentially much higher resolving power which could be estimated as $$R_{wt} \approx N \cdot \frac{T \cdot \alpha_{wt}}{dT}$$

where N is the number of full oscillations (each having period 2 T) for a given m/z during the detection time and $a_{wt}$ is overhead from spectrum processing ($a_{wt}$=0.5 . . . 1).

If Fourier Transformation is used for the harmonic signal, its resolving power for the best possible case of absorption mode could be estimated as $$R_{FT} \approx N \cdot a_{FT}$$

where $a_{FT}$ is an overhead coefficient stemming from apodization ($a_{FT}$=0.4 . . . 0.8). More detail is provided regarding this in EP-2372747 and US-2011/240841. Thus, the use of wavelet transformation provides a gain in resolving power, G, of about $$G = R_{wt}/R_{FT} \approx T/dT.$$

As an example, L=6 mm, d=2 mm for a practical Orbitrap system, so G=T/dT=9.4. This is a significant benefit. Moreover, this gain is independent of m/z. Unfortunately, this gain could be realised only for peaks with a signal so strong that is detectable over a small number of oscillations. For more realistic cases of lower Signal-to-Noise ratio (S/N), this gain would be at least √2 times lower. Nevertheless, this amounts to a gain in resolving power of over 6.

As shown for example in Bruce J. E. et al ("Trapping, Detection, and Mass Measurement of Individual Ions in a Fourier Transform Ion Cyclotron Resonance Mass Spectrometer." J. Am. Chem. Soc. Mass Spectrom. 1994, 116, p. 1839-1841) and Makarov A. A. et al ("Dynamics of ions of intact proteins in the Orbitrap mass analyzer". J. Am. Soc. Mass Spectrom. 2009, 20, p. 1486-1495), modern image current detection electronics is capable of detecting just few (for instance, 3 to 5) elementary charges ($\bar{e}$), especially when the duration of detection τ is long enough (for example 0.5 to 2 seconds). This sensitivity is limited by thermal noise of input transistors of the differential preamplifier. For shorter acquisitions, the S/N scales as $(1/\tau)^{1/2}$. For example, an ion peak containing 1000$\bar{e}$ and producing a harmonic transient with S/N=200 in an acquisition duration of 1 s would have S/N=20 in 10 ms acquisition.

For the same ion peak, a S/N achieved with pulse image current detection on strip electrodes 91 and 92 would be a factor of √G lower than for Fourier transformation simply due to G-times lower effective detection time. So for the example above, S/N=6 in 10 ms acquisition.

Ion peaks detected by pulse image current detection could then be used to form a mass spectrum directly. Alternatively, they may be used to provide the initial spectral line list for further processing of harmonic transient using non-FT methods (for example those described in the background section of this disclosure), preferably FDM. An embodiment employing such an approach is now described.

Data from harmonic transients, in their turn, could be used to exclude certain harmonics appearing in the line list resulting from the wavelet transform. As a result, such iterative processing would give better robustness than each method used separately.

Figure 4:
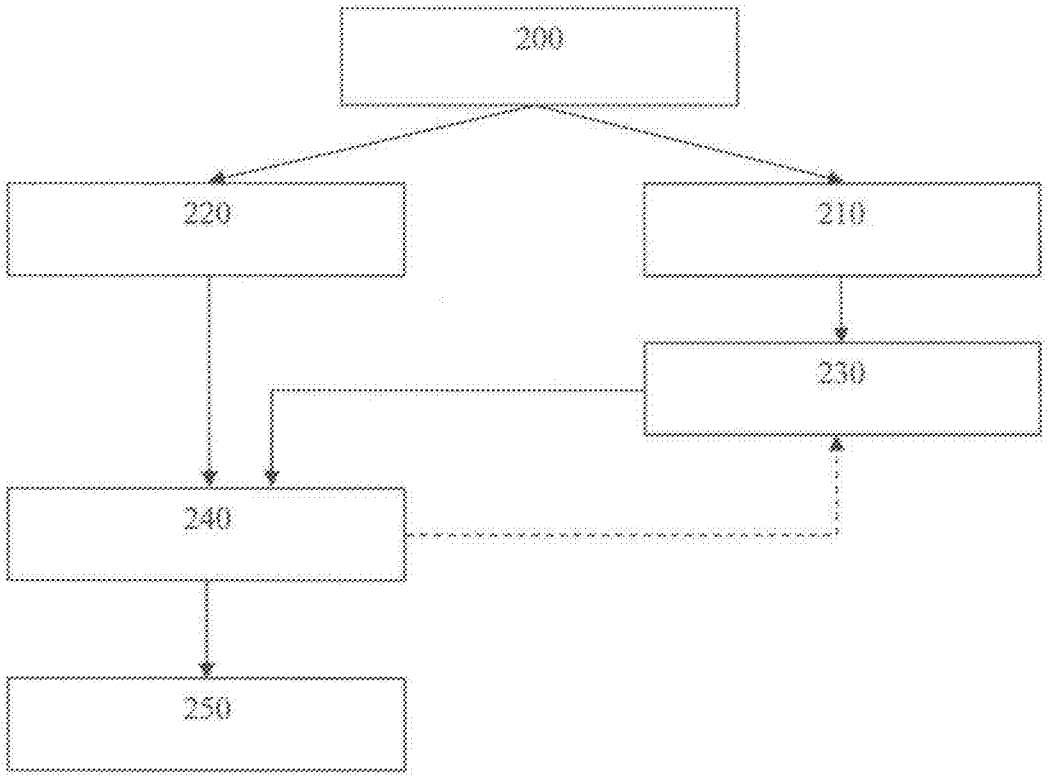
FIG. 4 depicts a flowchart of an analysis method in accordance with the present invention, for use with the embodiment shown in FIG. 2.

FIG. 4 shows a flowchart of a possible analysis method in accordance with the present invention, along these lines. This can be used, for example, with the embodiment shown in FIG. 2.

In a first step 200, at least one ion packet is injected into the mass analyzer. Then, in a detection step for a pulse transient image current 210 and a detection step for a harmonic transient image current 220 are carried out in parallel, at essentially the same time. In an extraction step 230, a list of spectral lines (line list) comprising the extracted frequencies and associated intensities of peaks is extracted from the obtained pulse transient image current. This is obtained using wavelet transformation for example.

This line list is then used, together with the obtained harmonic transient image current in FDM step 240 to obtain an enhanced line list. This uses the Filter Diagonalization Method referenced above. Extraction step 230 and FDM step 240 are repeated iteratively until a final mass spectrum is obtained in end step 250.

There are a number of practical considerations in the design of the electrodes for the electrostatic trap 80.

The resistance between the strip electrodes 91 and 92 is desirably much higher than the input resistance of typical preamplifiers and typically exceeds hundreds of MΩ. However, it is preferable not to have resistance above $10^{12}$ to $10^{14}\Omega$ to avoid possible charging of dielectric between strips. Metal doped glass or ceramics could be used to this effect.

If detection is performed on the central electrode 90, it is preferable to keep this electrode at virtual ground. Thus, a high-voltage ramp should be applied to the outer electrodes 84 and 85 and to the deflection lens arrangement 70. This could make the offset of the linear trap 60 considerably higher. Alternatively, preamplifiers could be made floating at the voltage of the central electrode 90 or capacitively or inductively coupled to it. In the latter case it would be preferable to shunt the inputs of the preamplifier during the ramp of the central electrode using relays or FET transistors.

Figure 5A:
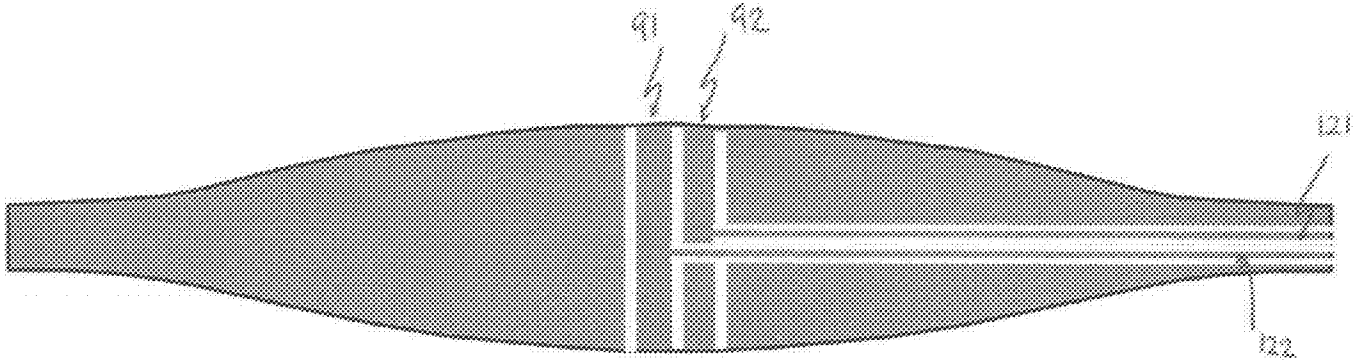
FIG. 5A shows a first variant of an electrode for use in the embodiment shown in FIG. 2.

Electrical connection to strip electrodes 91 and 92 could be made in a number of different ways. Referring first to FIG. 5A, there is shown a first variant of a central electrode 90 for use in the embodiment shown in FIG. 2. In this embodiment, thin conductors are routed from the same side of the central electrode to said strip electrodes 91 and 92. A first thin conductor 121 is connected by metallisation of the central electrode 90 to first strip electrode 91 and a second thin conductor 122 is connected by metallisation of the central electrode 90 to second strip electrode 92.

Figure 5B:
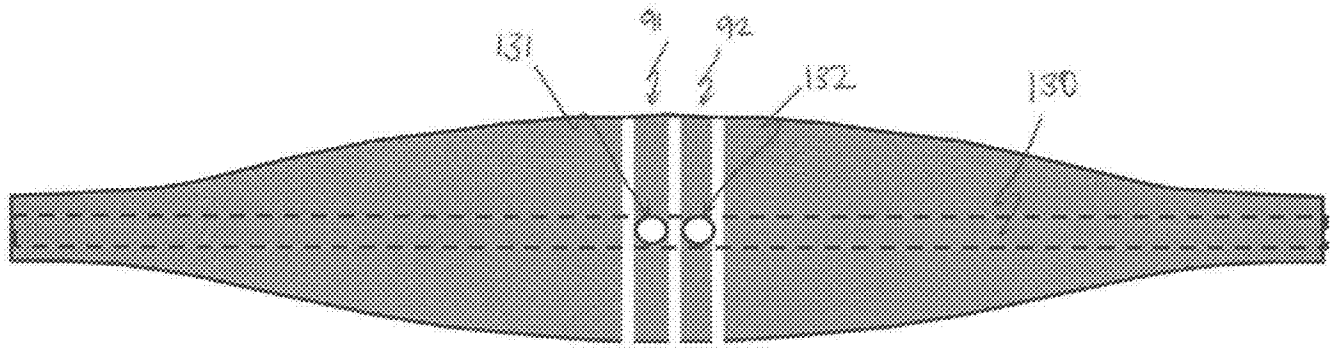
FIG. 5B shows a second variant of the electrode for use in the embodiment of FIG. 2.

An alternative approach is shown in FIG. 5B, in which there is shown a second variant of the electrode for use in the embodiment of FIG. 2. In this approach, the central electrode 90 is made out of tube 130 and then a hole 131 is drilled, preferably by laser, from outside the electrode into the inner bore of tube 130. A similar process is used to create a second hole 132. After machining, the entire central electrode 90 could be metallised by sputtering from outside and then selectively processed by laser to remove unwanted metal and form both strip electrodes 91 and 92. Holes 131 and 132 to the inner bore are left metallised and used to provide electrical contact to metal springs inserted into them (not shown). Electrical connections are then provided inside the inner bore 130 to contact the springs and bring signal connections outside the analyzer.

The method of data analysis described above is particularly suitable for MS/MS spectrometry where the number of peaks is quite limited (for instance, a few tens to a few hundreds). In existing data-dependent analytical methods, a single high-resolution high dynamic range scan is typically followed by a multitude of MS/MS scans so the method disclosed above could provide a considerable gain in speed.

For high-resolution high dynamic range scans, it is preferable to have longer transients than for MS/MS to address better much higher requirements to resolution and dynamic range in such scans.

Figure 6:
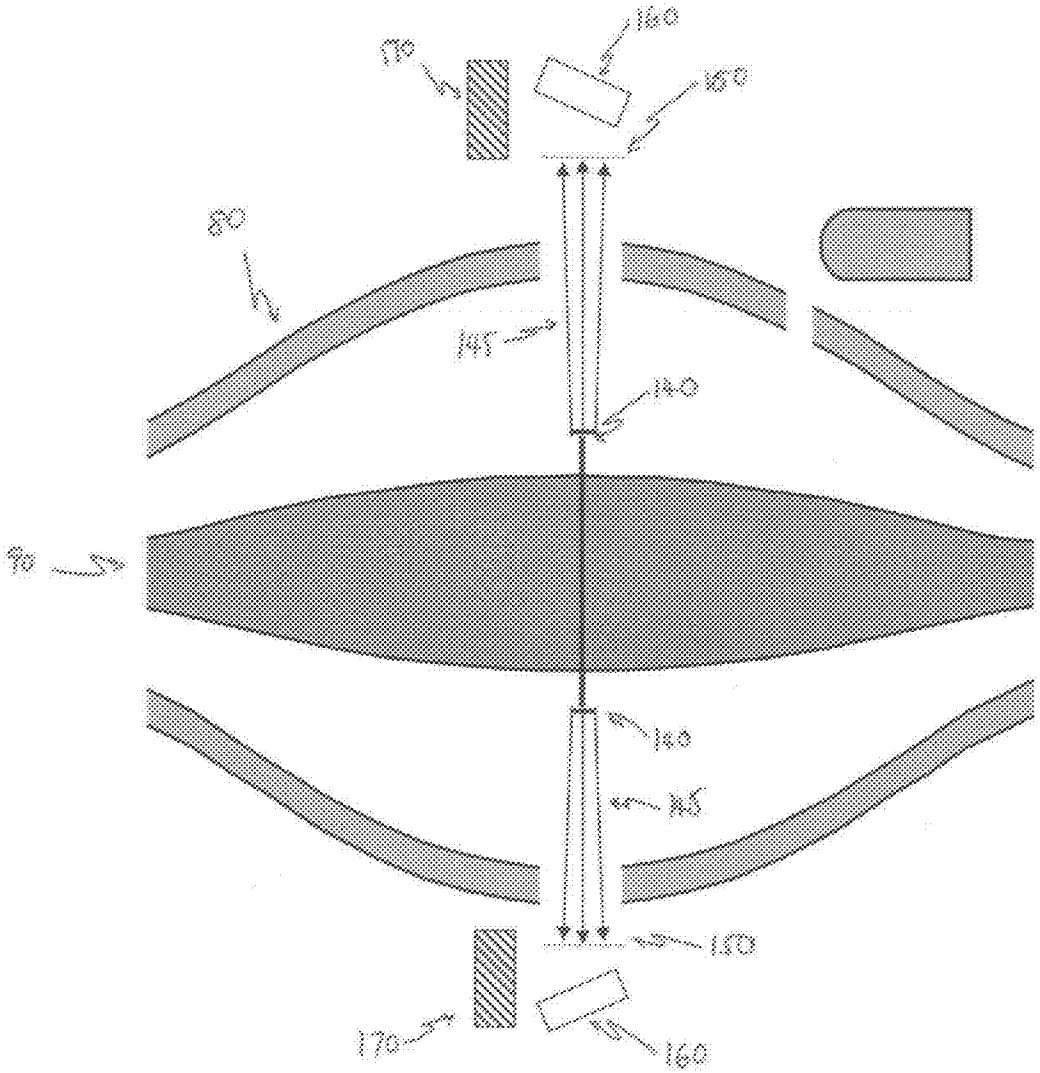
FIG. 6 shows a second embodiment of an electrostatic trap according to the present invention.

Referring now to FIG. 6, a second embodiment of an electrostatic trap according to the present invention is shown. This embodiment functions according to similar principles as the embodiment shown in FIG. 2. However in this case, pulse detection is performed with the help of secondary electron detection. A conversion electrode 140 is mounted on the central electrode 90 and a grid electrode 150, dynode 160 and microchannel plates 170 are also provided.

Firstly, conventional image current detection is performed with ions moving at a considerable distance from a conversion electrode 100. In this way, the harmonic transient image current is obtained. Subsequently, the voltage on the central electrode 90 is ramped slightly so that ions start to move on trajectories that intersect with the conversion electrode 140. This electrode has a different voltage to that applied to the central electrode 90, so that the equipotentials within the electrostatic trap 80 are not perturbed.

On each pass, a portion of the ion beam hits the conversion electrode 140. For positive ions, this causes secondary ions or electrons 145 (or secondary light positive ions, for negative ions) to be repetitively emitted and guided by the electric field of the electrostatic trap through the outer grid electrode 150 to dynode 160 and then to microchannel plates 170. This creates signals similar to those shown in FIG. 3, but with much higher S/N. Preferably, tens to hundreds of pulses are registered before the complete decay of signal, thus taking only a fraction of a millisecond. To improve the conversion efficiency of primary ions into secondary ions or electrons, special coatings could be applied to the conversion electrode 140, such as alkali metals or nanotubes. Even though the use of secondary ions broadens peaks in the mass spectrum, due to the spread in time-of-flight from the conversion electrode 140 to detector 170, this broadening is negligible comparing to the period of oscillations and therefore does not noticeably affect the gain, G.

This embodiment can also be combined with the analysis methodology described in relation to FIG. 4, although the statistical nature of detected pulses is also desirably taken into account. Consequently, the skilled person will recognise that the pulse transient signal need not be obtained through image current detection. Other suitable techniques for obtaining the pulse transient signal can be employed.

Although embodiments of the disclosure have been described above, the skilled person will contemplate various modifications. For example, it will be recognised that the locations of the detection electrodes used for obtaining a pulse transient signal may be different from those described. These electrodes may be located on the central, inner electrode or the outer electrode. Moreover, the detection electrodes used for obtaining a harmonic transient signal may be different, for example, the split outer electrodes 84 and 85 may be used for this purpose.

A differential output may again be obtained by processing the signals obtained by the two outer electrodes through a differential amplifier. This could potentially avoid the increase to the third harmonic in the harmonic transient image current noted above. However, by detecting the harmonic transient signal using the outer electrodes 84 and 85 is more difficult as these electrodes are floating in this particular embodiment and, due to this, the signal obtained from them will also then be more noisy.

It will be appreciated that more than two pulse transient signals can be obtained. These can then be used to improve the mass spectrum, as suggested by the embodiment shown in FIG. 4, in combination with the information obtained from the harmonic transient signal.

Figure 7:
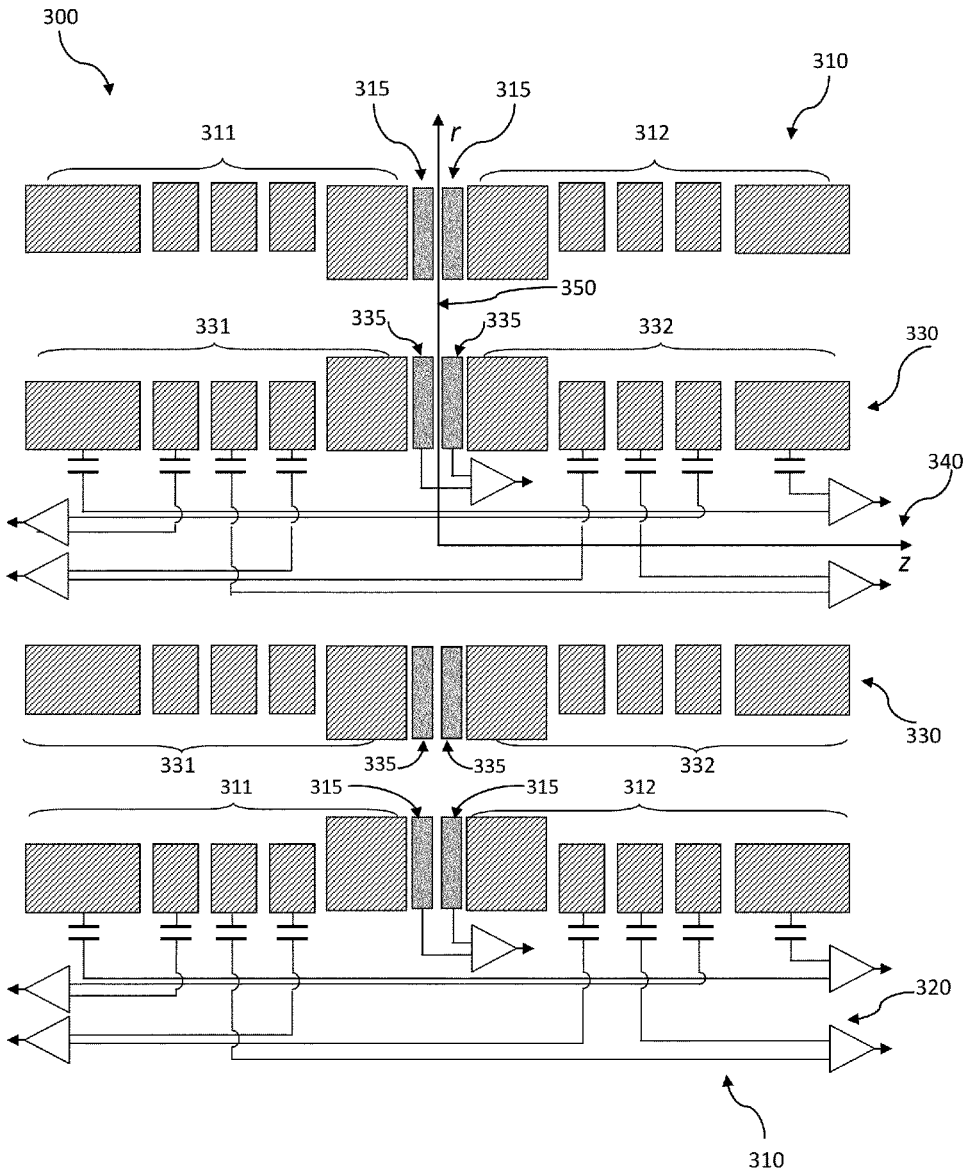
FIG. 7 shows an example of an arrangement for harmonic detection using multiple-electrodes.

Referring to FIG. 7, there is shown an example of an system for harmonic detection using multiple electrodes, which may be considered a orbital multi-electrode trap 300. The arrangement comprises: outer electrode arrangement 310; outer electrode detection circuitry 320; inner electrode arrangement 330; and inner electrode detection circuitry 340. The inner electrode arrangement 330 and the outer electrode arrangement 310 are coaxial to the longitudinal axis Z.

The outer electrode arrangement 310 comprises: first side outer electrode arrangement 311; second side outer electrode arrangement 312; and outer pulse detection electrodes 315. The inner electrode arrangement 330 correspondingly comprises: first side inner electrode arrangement 331; second side inner electrode arrangement 332; and inner pulse detection electrodes 335. Thus, image current detection is performed on both inner electrode arrangement 310 and outer electrode arrangement 330. Pulse detection is performed on both the outer pulse detection electrodes 315 and the inner pulse detection electrodes 335, which are both positioned inside a field-free region 350.

A harmonic transient can be obtained using not two, but multiple detection electrodes (for instance, as shown in FIG. 7). It is also worth noting that the image current detection takes place not only in the regions of high axial velocity of ions but also near the turning points of ion trajectories. This differentiates the arrangement from existing systems and allows retrieval of information that would otherwise be lost, even with the use of multiple detection electrodes, such as described in WO-2010/072137.

Moreover, the present invention is not limited to use with only Orbitrap mass analyzers. It could be also applied to any other type of electrostatic trap such as: a orbital multi-electrode trap (such as shown in FIG. 7); traps with multiple in-line reflections; and sector traps with multiple turns. In the latter case, ions are constantly turning, so instead of detection at the turning point, it is desirable to sustain harmonic detection over a substantial share of the entire time of analysis, preferably at least 30 to 50%.

The present invention is also applicable to FT-ICR mass analyzers, where the preferred embodiment includes a cylindrical cell containing wide and narrow segments. With an ion thread excited to a radius sufficiently close to the cell boundary, wide segment electrodes could be used for harmonic detection with a duty cycle exceeding 50%. Narrow segment electrodes could be used for pulse detection with resolution gain of G=5 . . . 20 (depending on the proximity of the ion beam to the electrodes). Narrow segment electrodes could also protrude into the cell to improve G.

Also, although the use of wavelet transformations have been described above, the skilled person will recognise that other analysis techniques or transformations may be used, such as those described in the background section of this disclosure.

The invention claimed is:

1. A mass analyzer, comprising:

an electrostatic field generator, arranged to provide an electrostatic field causing ion packets to oscillate along a longitudinal direction with a period;

a pulse detection electrode arrangement, configured to detect a pulse transient signal over a time duration that is significantly shorter than the period of the ion packet oscillation, wherein the pulse detection electrode arrangement comprises a conversion electrode mounted interior to the mass analyzer, a first pulse detection electrode, and a second pulse detection electrode, the electrostatic field being configured such that ion packets hit the conversion electrode, causing secondary particles to be emitted and an external detection electrode arrangement mounted exterior to the mass analyzer and located to detect the secondary particles from the conversion electrode;

a pulse differential amplifier, arranged to provide the pulse transient signal based on the difference between a detection signal generated in the first pulse detection electrode and a detection signal generated in the second pulse detection electrode; and a processor, configured to identify ion intensity with respect to mass-to-charge ratio, based on the pulse transient signal.

2. The mass analyzer of claim 1, wherein the external detection electrode arrangement comprises a secondary particle multiplier.

3. The mass analyzer of claim 1, wherein the external detection electrode arrangement comprises:

a grid electrode mounted exterior to the mass analyzer and located to receive the secondary particles from the conversion electrode;

a dynode, arranged to receive secondary electrons from the grid electrode; and microchannel plates, arranged to detect secondary electrons received from the dynode.

4. The mass analyzer of claim 1, wherein the processor is configured to identify ion intensity with respect to mass-to-charge ratio by processing of the pulse transient signal using at least one of: auto-correlation; linear prediction; filter diagonalization method; any other harmonic inversion method; and wavelet transformation.

5. The mass analyzer of claim 1, further comprising: an outer electrode coaxial with at least an inner electrode, the electrostatic field generator arranged to provide the electrostatic field between the outer electrode and the inner electrode.

6. The mass analyzer of claim 1, wherein the conversion electrode is spatially separated from the inner electrode and the outer electrode.

7. A method of ion detection for a mass analyzer in which ions are caused to form ion packets that oscillate along a longitudinal direction with a period, the method comprising:

detecting a first pulse transient signal over a time duration that is significantly shorter than the period of the ion packet oscillation by causing ion packets to hit a conversion electrode mounted interior to the mass analyzer, so that secondary particles are emitted and detecting the secondary particles exterior to the mass analyzer;

using a pulse differential amplifier to provide a second pulse transient signal based on the difference between a detection signal generated in a first pulse detection electrode and a detection signal generated in a second pulse detection electrode; and identifying ion intensity with respect to mass-to-charge ratio, based on the first pulse transient signal and the second pulse transient signal.

8. The method of claim 7, wherein the step of identifying ion intensity with respect to mass-to-charge ratio comprises processing the pulse transient signal using at least one of: auto-correlation; linear prediction; filter diagonalization method; and wavelet transformation.

9. The method of claim 7, wherein the mass analyzer further comprises: an outer electrode coaxial with an inner electrode, the ion packets being caused to oscillate by an electrostatic field between the outer electrode and the inner electrode.

10. The method of claim 7, wherein detecting the secondary particles exterior to the mass analyzer includes amplifying the secondary particles using a secondary particles multiplier.

11. The method of claim 7, wherein detecting the secondary particles exterior to the mass analyzer includes:

receiving the secondary particles from the conversion electrode at a grid electrode mounted exterior to the mass analyzer;

receiving secondary electrons from the grid electrode at a dynode; and detecting secondary electrons received from the dynode at microchannel plates.

* * * * *